United States Patent [19]

Giger

[11] 4,048,835

[45] Sept. 20, 1977

[54] METHOD OF PUNCHING A SMALL HOLE IN A PRECISION MECHANICS WORKPIECE

[75] Inventor: Urs Giger, Solothurn, Switzerland

[73] Assignee: Eta A.G. Ebauches-Fabrik, Switzerland

[21] Appl. No.: 718,213

[22] Filed: Aug. 27, 1976

[30] Foreign Application Priority Data

Sept. 16, 1975 Switzerland ..... 11958/75

[51] Int. Cl.[2] ..... B21D 53/10

[52] U.S. Cl. ..... 72/334; 29/177

[58] Field of Search ..... 72/334, 333, 332, 325, 72/324; 29/177, 178, 179, 432.1, 564

[56] References Cited

U.S. PATENT DOCUMENTS 902,322 10/1908 Porter ..... 29/177

2,291,456 7/1942 Dumaine et al. ..... 29/177

3,354,689 11/1967 Tirone ..... 72/334

*Primary Examiner*—Lowell A. Larson

*Attorney, Agent, or Firm*—Stevens, Davis, Miller & Mosher

[57] ABSTRACT

A method of punching a small hole in a precision mechanics workpiece, in that the thickness of the workpiece is reduced by the application of pressure in the region where the small hole is to be punched and the material is thereby strengthened, steps being taken to cause the material subjected to pressure to be displaced in the direction of pressure and to yield at right angles hereto. The small hole is punched in the region subjected to pressure at a distance from the edge of that region corresponding at least to the diameter of the small hole, so that the small hole is certain to be punched at a location in that region where the material is strengthened and sound.

4 Claims, 5 Drawing Figures

METHOD OF PUNCHING A SMALL HOLE IN A PRECISION MECHANICS WORKPIECE

Figure 1:
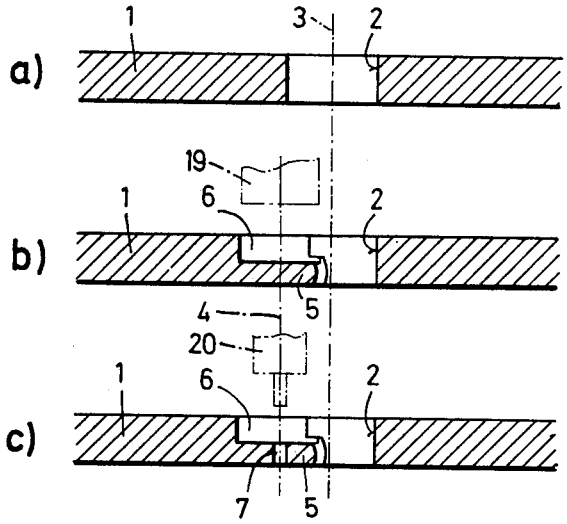

This invention relates to a method of punching a small hole in a precision mechanics workpiece, particularly in a component of a timepiece movement, of the type wherein pressure is exerted upon a predetermind region of the workpiece in such a way that a portion of the material of which the workpiece is made yields and is displaced so that the thickness of the predetermined region becomes less than the thickness of the remainder of the workpiece.

It is a well-known fact that when small holes are to be punched, the diameter of the holes must not be too small as compared with the thickness of the workpiece if the edge life of the punching tool is to be kept within acceptable limits.

It is also known that when holes having a diameter of about 0.1 mm. or greater are to be punched, e.g., in components of timepiece movements, the thickness of the material and the diameter of the hole must be in a certain ratio to one another. If, for example, the workpiece or timepiece component is made of brass, this ratio is $$\frac{\text{thickness of material}}{\text{diameter of hole}} \leqq 1.50$$

This ratio depends upon the quality of the material of which the workpiece or component is made, upon the material and the quality of the punching tool used, and upon the permissible edge life of that tool. This ratio is generally no more than 1 for punching holes with a diameter of 0.1 mm. and approaches the value of 1.5 rather for punching holes having a diameter of 0.3 mm.

Very often, however, the workpiece or timepiece component is considerably thicker than is suitable for punching a small hole. It has therefore been customary until now to reduce the thickness of the workpiece or timepiece component by first carrying out a machining operation, e.g., a milling operation, in the region in which the hole is to be punched. However, such a machining operation is inefficient.

Hence it has also already been proposed first to punch a round opening of a size such as presents no problems with respect to the thickness of the component, this opening being considerably larger in diameter than the small hole ultimately desired. Next, a depression concentric with the opening is pressed into the component by means of a stamp die having a diameter greater than that of the opening, the thickness of the component thereby being reduced to that suitable for stamping the small hole, and the diameter of the pre-punched opening being decreased to a point where it is less than the diameter of the desired hole. The latter hole is then punched concentrically with the aforementioned depression. As compared with the previous method described, this second method presents the advantage that the desired hole can be produced more efficiently. However, the quality of holes produced in this way leaves something to be desired because the material displaced towards the middle of the opening during stamping of the depression has a poor-quality marginal region. It is precisely out of this intermediate marginal region that the desired hole is punched, so that as a rule, the inside wall of the punched hole presents irregularities. For that reason, such holes are not suitable for receiving shaft journals and cannot be used as a snug seat for pins.

It is an object of this invention to provide a method of the type initially mentioned which enables small holes of very good quality to be punched in precision mechanics workpieces, such as components of timepiece movements, in an efficient manner.

To this end, the method according to the present invention comprises the improvement of exerting the pressure in such a way that the material is displaced in the direction of the pressure and yields at right angles to the pressure, and punching the hole in the pressed region at a location such that the distance between the edge of the hole and the edge of the pressed region is equal to or greater than the diameter of the hole.

Figure 2:
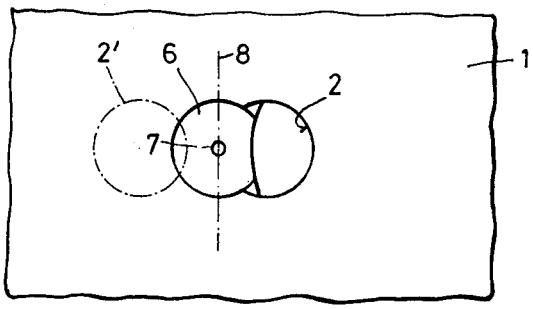
Figure 3:
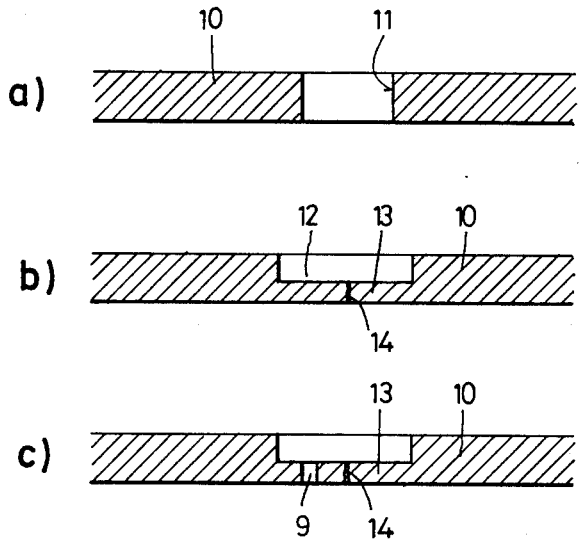
Figure 4:
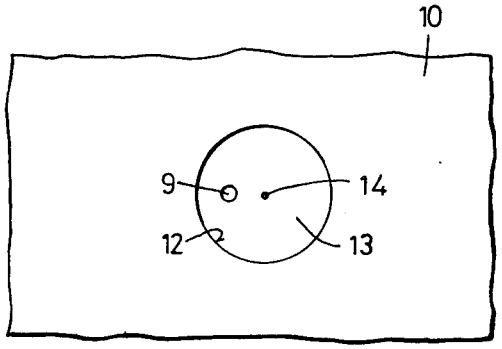
Figure 5:
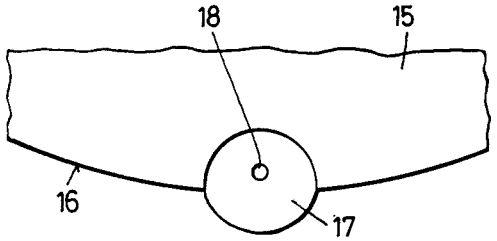

Preferred embodiments of the invention will now be described in detail with reference to the accompanying drawings, in which:

FIG. 1 is a cross-section of part of a workpiece, showing three phases of operation, FIG. 2 is a top plan view of the workpiece part shown in FIG. 1, in which a small-diameter hole has been punched, FIG. 3 is a cross-section of part of another workpiece, showing three phases of operation, FIG. 4 is a top plan view of the workpiece part shown in FIG. 3, in which a small-diameter hole has been punched, and FIG. 5 is a top plan view of part of still another workpiece, in the edge area of which a depression has been impressed.

FIGS. 1 and 2 show a greatly enlarged part of a workpiece 1, which may, for example, be a plate or a bridge for a timepiece movement. As illustrated in FIG. 1*a*, a round opening 2, the diameter of which is approximately double the thickness of the workpiece 1, is first punched out along an axis 3. Next, a portion of the edge area of the opening 2 is compressed by means of a preferably cylindrical stamp die 19 which is moved along another axis 4 until the thickness of the edge area of the opening 2 acted upon by the stamp die 19 has been reduced to the desired extent. During this operation, part of the material beneath the stamp die 19 is displaced into the opening 2 and forms a projection 5 constituting the bottom of a depression 6 (FIG. 1*b*.)

The diameters of the opening 2 and of the depression 6, and the distance between the axes 3 and 4, are such that the depression 6 and the opening 2 overlap one another. Preferably, the diameter of the depression 6 is equal to that of the opening 2.

Only after formation of the projection 5 is a desired small hole 7 punched in the bottom of the depression 6 by means of a punch 20, preferably along the axis 4, so that the depression 6 and the hole 7 are concentric, as may be seen in FIGS. 1*c* and 2. The hole 7 is not situated in the indeterminate marginal region of the deformed material but rather in a zone of the deformed material of homogeneous structure, the stamping action having made the deformed material harder than the non-deformed material. The quality of the hole 7 produced in this manner is therefore very good, and the inside wall of the hole 7 presents no irregularities. Consequently, the hole 7 may be used for receiving a shaft journal or as a snug seat for a pin.

Instead of just one opening 2, a second opening 2' may also be punched in the workpiece 1, as indicated by a dot-dash line in FIG. 2. The distance between the centers of the openings 2 and 2' is such that these openings are separated by a remaining portion of material. The depression 6 is then impressed in the region of this remaining portion by the stamp die 19. The advantage of this embodiment of the method is that the end face of the stamp die 19 is loaded substantially symmetrically, and the material is displaced on both sides of a straight dot-dash line 8 appearing in FIG. 2.

FIGS. 3 and 4 illustrate a further embodiment of the invention for punching a small hole 9 in a workpiece 10. As shown in FIG. 3*a*, a round opening 11 is likewise first punched in the workpiece 10. Next, a depression 12 is stamped in the workpiece 10 by means of the stamp die 19, the material displaced during stamping virtually or completely closing the previously punched opening 11 and forming the bottom 13 of the depression 12 (FIG. 3*b*). An indeterminate region 14 remains in the middle of the bottom 13. The small hole 9 is then punched at a location between the cylindrical wall of the depression 12 and the region 14 and is thus situated in a part of the bottom 13 consisting of material hardened by the stamping operation.

If the small hole is supposed to be disposed symmetrically to the central plane of the workpiece, a depression 6 or 12 may be stamped on both sides of the workpiece. If necessary, the two stamping depths may also be unequal.

FIG. 5 illustrates an embodiment of the method for punching a small hole 18 near an edge 16 of a workpiece 15. Here the round opening 2 is replaced by just a part-circular opening punched at the edge 16. Assuming that the workpiece 15 is one in which it is of no hindrance to have part of the material projecting beyond the edge 16, the stamp die 19 may then be used to deform part of the edge area of the workpiece 15. In a zone 17 upon which the stamp die 19 has acted, part of which zone 17 projects beyond the edge 16, the material is strengthened, and the thickness of the workpiece is reduced to the desired dimension. The small hole 18 is then punched preferably at the center of the zone 17.

As compared with prior art methods, the punching method described above presents the additional advantage that the life of the tool 20 used for punching the small hole is longer because the correspondingly small end face of the tool 20 is uniformly loaded. This is not so in the case of the known methods because the punch penetrates the material at a location at which the material distribution is, by its very nature, not homogeneous, being in an unsound marginal zone.

What is claimed is:

1. In a method of punching a small hole in a precision mechanics workpiece such as a component of a timepiece movement, which includes exerting pressure upon a predetermined region of a workpiece in such a way that a portion of the material of which said workpiece is made yields and is displaced so that the thickness of said region becomes less than the thickness of the remainder of said workpiece, the improvement comprising the steps of:

exerting said pressure in such a way that said material is displaced in the direction of said pressure and yields at right angles to said pressure to form a region of reduced thickness, and punching said hole of a diameter from about 0.1 to 0.3 mm in said region at a location such that the distance between the edge of said hole and the edge of said region is greater than the diameter of said hole and the area of said region is at least five times as great as the cross-sectional area of the hole.

2. A method according to claim 1, further comprising the step of first making an opening of larger dimensions than said hole in said workpiece, exerting said pressure upon at least part of the edge region of said opening by means of a stamp die, and thereafter punching said hole along a line parallel to and spaced from the longitudinal axis of said opening.

3. A method according to claim 2, wherein said stamp die is moved along a line parallel to and spaced from the longitudinal axis of said opening for exerting said pressure, a portion of said stamp die covering said opening, and said punching tool being moved with respect to said workpiece along the same straight line as said stamp die.

4. A method according to claim 1, wherein said pressure is exerted by means of a stamp die upon an edge region of said workpiece, thereby displacing said material so that a portion thereof projects beyond said edge of said workpiece.

* * * * *